US007452034B2

(12) United States Patent
Jung

(10) Patent No.: US 7,452,034 B2
(45) Date of Patent: Nov. 18, 2008

(54) FOOT SUPPORTING APPARATUS OF A CHAIR

(75) Inventor: Kwan-Young Jung, Goyang-Si (KR)

(73) Assignee: Duoback Korea Co., Ltd., Incheon (KR)

( * ) Notice: Subject to any disclaimer, the term of this patent is extended or adjusted under 35 U.S.C. 154(b) by 0 days.

(21) Appl. No.: 11/706,026

(22) Filed: Feb. 14, 2007

(65) Prior Publication Data

US 2008/0157572 A1 Jul. 3, 2008

(30) Foreign Application Priority Data

Dec. 27, 2006 (KR) ..... 10-2006-0135387

(51) Int. Cl.
*A47C 7/50* (2006.01)
*A47C 7/52* (2006.01)
*A47C 16/02* (2006.01)

(52) U.S. Cl. ..... 297/423.1; 297/423.25; 297/423.37; 297/423.4; 248/188.7

(58) Field of Classification Search ..... 297/423.1, 297/423.21, 423.25, 423.37, 423.4; 248/188.7
See application file for complete search history.

(56) References Cited

U.S. PATENT DOCUMENTS 3,820,844 A * 6/1974 Fortnam ..... 297/423.37
5,836,555 A * 11/1998 Ellsworth et al. ..... 297/423.1 X
6,142,571 A * 11/2000 Benden ..... 297/423.4
6,607,246 B1 * 8/2003 Benden ..... 297/423.4
7,036,886 B2 * 5/2006 Benden et al. ..... 297/423.25
2003/0151291 A1 8/2003 Lin et al.
2005/0253441 A1 11/2005 Benden et al.

FOREIGN PATENT DOCUMENTS

KR 10-2001-0107193 12/2001

OTHER PUBLICATIONS

Picture of a foot supporter used in Japan, before Feb. 14, 2007.

* cited by examiner

*Primary Examiner*—Rodney B. White
(74) *Attorney, Agent, or Firm*—Knobbe Martens Olson Bear LLP

(57) ABSTRACT

A foot supporting apparatus of a chair is disclosed. In one embodiment, the apparatus includes: i) a first foot supporting body that has a sector shape and that is contacted on a seat supporter, ii) a second foot supporting body that has a sector shape and that is rotatably disposed on the first foot supporting body such that the second foot supporting body is wrapped around the seat supporter with the first foot supporting body at need and iii) a coupling part that couples the second foot supporting body to the first foot supporting body or that uncouples the second foot supporting body from the first foot supporting body. According to one embodiment, the height of the foot supporting apparatus can be adjusted according to the length of the legs of the user, and the force of the feet of the user can be fully supported.

7 Claims, 8 Drawing Sheets

FOOT SUPPORTING APPARATUS OF A CHAIR

CROSS-REFERENCE TO RELATED APPLICATION

This application claims priority to and the benefit of Korean Patent Application No. 10-2006-0135387 filed in the Korean Intellectual Property Office on Dec. 27, 2006, the entire contents of which are incorporated herein by reference.

BACKGROUND OF THE INVENTION (a) Field of the Invention

The present invention relates to a chair. More particularly, the present invention relates to a foot supporting apparatus for use with a chair that can adjust the height thereof according to the length of the legs of a user, and that can fully support force that is generated from the feet of the user.

(b) Description of the Related Technology

In general, a chair includes, among other things, a seat that supports the buttocks of a user, and a seat supporter that is disposed between the seat and the ground so as to support the seat. Furthermore, the chair may further include a height adjusting unit that is disposed between the seat and the seat supporter so as to adjust the height of the seat.

Such a chair is used along with a desk that generally has the height of a standard size, and accordingly, in order to adjust a user's sitting height in correspondence to the height of the desk, generally not the height of the desk but the height of the seat of the chair is adjusted. Furthermore, if the height of the seat becomes high, a problem may occur that a user's feet do not contact the ground, in particular, in a case that a child uses the chair, the problem may become worse.

In particular, if the user sits on the chair for hours while not contacting the ground, since force that should be supported by the feet is transmitted to his spine, the user may have a spine pain. Furthermore, if a child maintains such a pose for hours, his spine may not be properly developed, resulting in spine associated problems.

The information disclosed in this section is only for enhancement of understanding of the background of the invention and should not be taken as an acknowledgement or any form of suggestion that this information forms the prior art that is already known in this country to a person of ordinary skill in the art.

SUMMARY OF CERTAIN INVENTIVE ASPECTS

One aspect of the present invention provides a foot supporting apparatus of a chair that can not only adjust height thereof according to length of the legs of a user but also can fully support force that is applied from the feet of the user.

Another aspect of the invention provides a foot supporting apparatus of a chair including: i) a first foot supporting body on which the feet of a user is placed, the first foot supporting body that has a sector shape and that is contacted on a seat supporter, ii) a second foot supporting body on which the feet of the user is placed, the second foot supporting body that has a sector shape and that is rotatably disposed on the first foot supporting body such that the second foot supporting body is wrapped around the seat supporter with the first foot supporting body at need and iii) a coupling part that couples the second foot supporting body to the first foot supporting body or that uncouples the second foot supporting body from the first foot supporting body, and wherein the coupling part couples the second foot supporting body to the first foot supporting body such that the first and second foot supporting bodies are fixed to a desired height of an outer surface of the seat supporter at need, and the coupling part offers coupling force to the outer surface.

In one embodiment, the first foot supporting body with the sector shape includes: i) a first round portion at which two radiuses of the sector shape are met each other, the first round portion that is concavely rounded toward a segment of the sector shape such that the seat supporter is contacted thereon, ii) a first connection portion that is extended from one end of the first round portion to one end of the segment, iii) a second connection portion that is extended from other end of the first round portion to other end of the segment and iv) a first foot supporting portion that is formed along the segment, one end of which is supported to the first connection portion, and other end of which is supported to the second connection portion.

In one embodiment, the second foot supporting body with the sector shape includes: i) a second round portion at which two radiuses of the sector shape are met each other, the second round portion that is concavely rounded toward a segment of the sector shape such that the seat supporter is contacted thereon, ii) a third connection portion that is extended from one end of the second round portion to one end of the segment, iii) a fourth connection portion that is extended from other end of the second round portion to other end of the segment and iv) a second foot supporting portion that is formed along the segment, one end of which is supported to the third connection portion, and other end of which is supported to the fourth connection portion.

The second foot supporting body may be rotatably mounted to the first foot supporting body by a rotation unit, and the rotation unit may include: i) a first extension portion that is extended from the one end of the first round portion along a concentric circle of the first round portion, ii) a second extension portion that is extended from the one end of the second round portion along a concentric circle of the second round portion, iii) a first mounting portion that is formed at an end of the first extension portion, iv) a second mounting portion that is formed at an end of the second extension portion and v) a pivot that is vertically penetrated through the first and second mounting portions.

The coupling part may include: a first coupling hole that is formed at the first connection portion a second coupling hole that is formed at the third connection portion and a bolt that is coupled to a nut after being sequentially inserted into the first and second coupling holes.

The foot supporting apparatus may further include an overlapping unit such that the second foot supporting body is overlapped with the first foot supporting body when the second foot supporting body is contacted on the first foot supporting body after the second foot supporting body is rotated.

The overlapping unit may include: a first projection portion that is formed on one end of the first foot supporting portion and a first insertion portion that is formed on the second foot supporting portion such that the first projection portion is inserted thereinto.

In one embodiment, the overlapping unit further includes: a second projection portion that is formed on one side surface of the first connection portion and a second insertion portion that is formed on one side surface of the second connection portion such that the second projection portion is inserted thereinto.

In one embodiment, the overlapping unit further includes: a third projection portion that is formed on other end of the first round portion and a third insertion portion that is formed on other end of the second round portion such that the third projection portion is inserted thereinto.

In one embodiment, the foot supporting apparatus further includes a supplementary coupling unit that is positioned between the first or second foot supporting body and the seat supporter such that the first and second foot supporting bodies are prevented from moving on the seat supporter.

In one embodiment, the supplementary coupling unit includes: a first groove that is formed to an interior circumference of the first round portion, a first friction pad that is adhered on the first groove, a second groove that is formed to an interior circumference of the second round portion and a second friction pad that is adhered on the second groove.

The first and second friction pads may be formed of a resilience material such that external impact is absorbed.

The foot supporting apparatus may further include a slip avoidance part that is disposed on each upper surface of the first and second foot supporting portions such that the feet of the user is prevented from slipping thereoff.

The slip avoidance part may include a plurality of protrusions that are formed on the each upper portion of the first and second foot supporting portions.

Radius and central angle of the first foot supporting body with the sector shape may be equal or substantially similar to those of the second foot supporting body with the sector shape.

The coupling part and the rotation unit may be substantially symmetrically positioned each other with respect to the seat supporter.

The coupling part may be positioned to a front direction of the chair with respect to the seat supporter, and the rotation unit may be positioned to a rear direction of the chair with respect to the seat supporter.

Another aspect of the invention provides a foot supporting apparatus for use with a chair, the apparatus including: i) a first foot supporting body configured to support at least one of the feet of a user, wherein the first foot supporting body has a sector shape, ii) a second foot supporting body configured to support at least one of the feet of the user, wherein the second foot supporting body has a sector shape and is rotatably connected to the first foot supporting body, and wherein the second foot supporting body is, together with the first foot supporting body, configured to surround an outer surface of a seat supporter of the chair and iii) a coupling section configured to couple the second foot supporting body to the first foot supporting body such that the two foot supporting bodies are held onto the seat supporter at a desired height, wherein the coupling section is further configured to uncouple the second foot supporting body from the first foot supporting body. In one embodiment, an opening is defined in each of the two supporting bodies, and wherein at least part of the coupling section is located in one of the openings.

Still another aspect of the invention provides a foot supporting apparatus for use with a chair, the apparatus including: i) a first foot rest including a first end, ii) a second foot rest including a second end, wherein the second foot rest is rotatably coupled to the first foot rest via the first and second ends, wherein the first and second ends are configured to surround and hold an exterior surface of a seat supporter of the chair in a position, and wherein the seat supporter is downwardly extended from the seat of the chair and iii) a connector configured to couple one of the two foot rests to the other so as to reach the position. In one embodiment, the foot supporting apparatus further includes a pivot configured to rotatably move one of the two foot rests with respect to the other, wherein the first and second foot rests are substantially symmetric in shape with respect to the pivot. In one embodiment, the foot supporting apparatus is incorporated into the chair.

Yet another aspect of the invention provides a foot supporting apparatus for use with a chair, the apparatus including: i) first means for supporting at least one of a user's feet, ii) second means for supporting at least one of the user's feet, wherein the second means is rotatably coupled to the first means, wherein the first and second means are configured to surround and hold an exterior surface of a seat supporter of the chair in a position and iii) means for removably attaching one of the two means to the other so as to reach the position.

DETAILED DESCRIPTION OF CERTAIN INVENTIVE EMBODIMENTS

Figure 1:
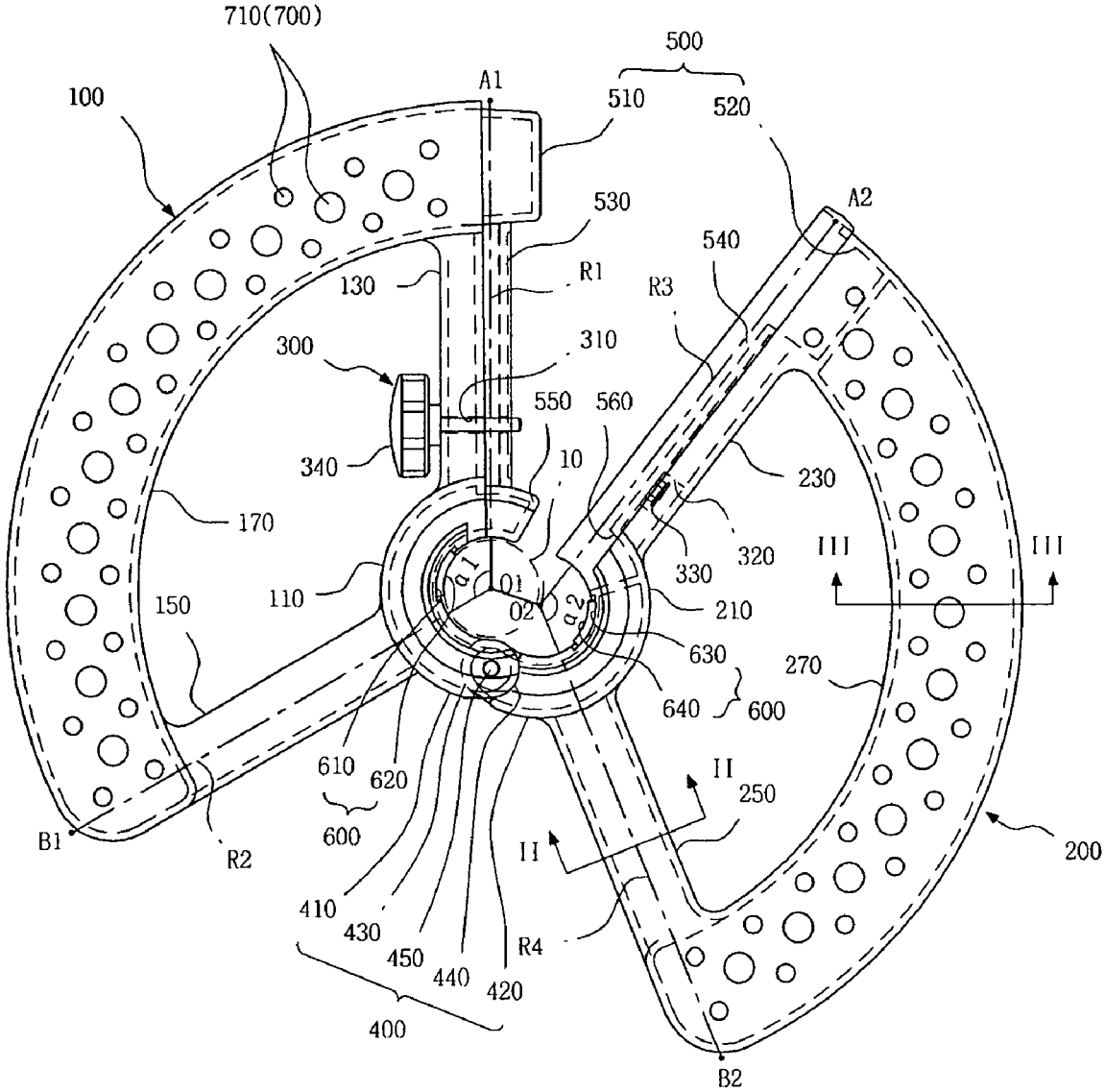
FIG. 1 is a top plane view showing a foot supporting apparatus according to an exemplary embodiment of the present invention.

Embodiment of the present invention will now be described more fully hereinafter with reference to the accompanying drawings, in which exemplary embodiments of the invention are shown. A foot supporting apparatus of a chair according to an exemplary embodiment of the present invention, as shown in FIG. 1, includes a first foot supporting body 100 with a sector shape, a second foot supporting body 200 with a sector shape, and a coupling part 300.

The first foot supporting body (or first foot rest) 100 on which the feet of a user is placed is contacted on a seat supporter 10. In one embodiment, the first foot supporting body 100 has the sector shape, and may include a first round portion 110, a first connection portion 130, a second connection portion 150, and a first foot supporting portion 170 that are disposed along an exterior circumference of the sector shape. In order to reduce weight and material cost, the first foot supporting body 100 may have an open type that a center portion thereof is opened. In another embodiment, the first foot supporting body 100 may have a closed type body. In another embodiment, a plurality of openings may be defined in the first foot supporting body 100. This applied to the second foot supporting body 200. In one embodiment, the first round portion 110 at which two radiuses (R1: first line segment A1-O1, R2: second line segment B1-O1) of the sector shape are met with each other may be concavely rounded toward a segment A1-B1 of the sector shape such that the seat supporter 10 is contacted thereon. The first connection portion 130 is extended from one end of the first round portion 110 to one end of the segment A1-B1. The second connection portion 150 is extended from other end of the first round portion 110 to other end of the segment A1-B1. The first foot supporting portion 170 is formed along the segment A1-B1, and one end thereof is supported to the first connection portion 130 and other end thereof is supported to the second connection portion 150.

The first foot supporting portion 170 may have a structure that is supported to the first round portion 110 by the first and second connection portions 130 and 150. In one embodiment, in order to simplify manufacture processes, the first round portion 110, the first connection portion 130, the second connection portion 150, and the first foot supporting portion 170 may be formed as a single body.

Figure 2:
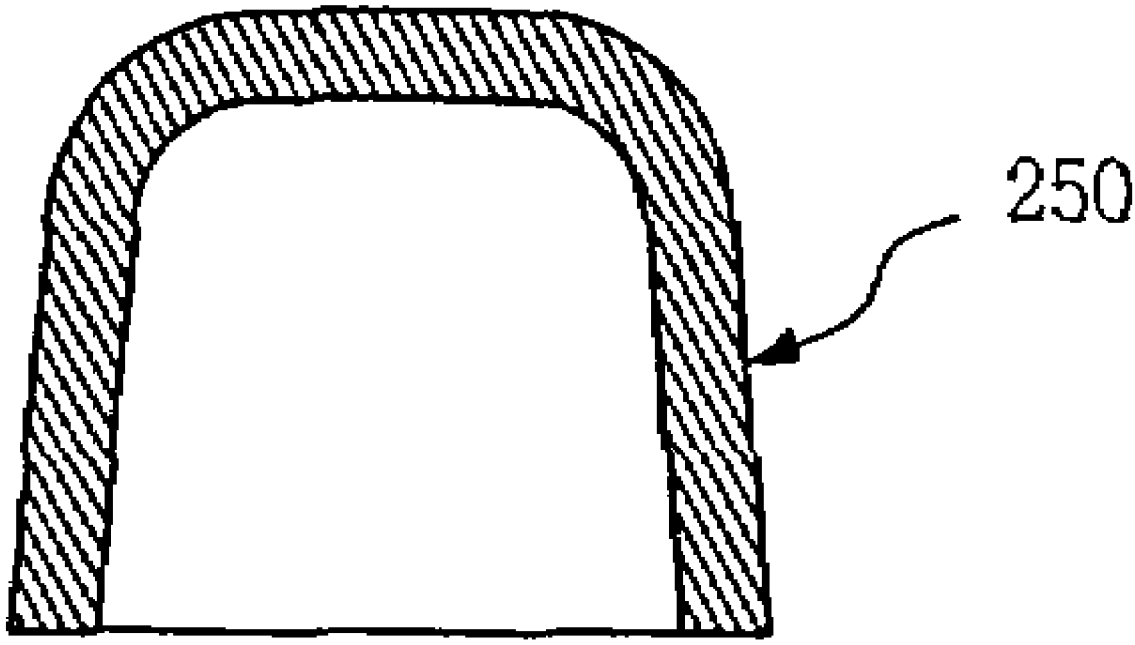
FIG. 2 is a section taken on line II-II in FIG. 1.
Figure 3:
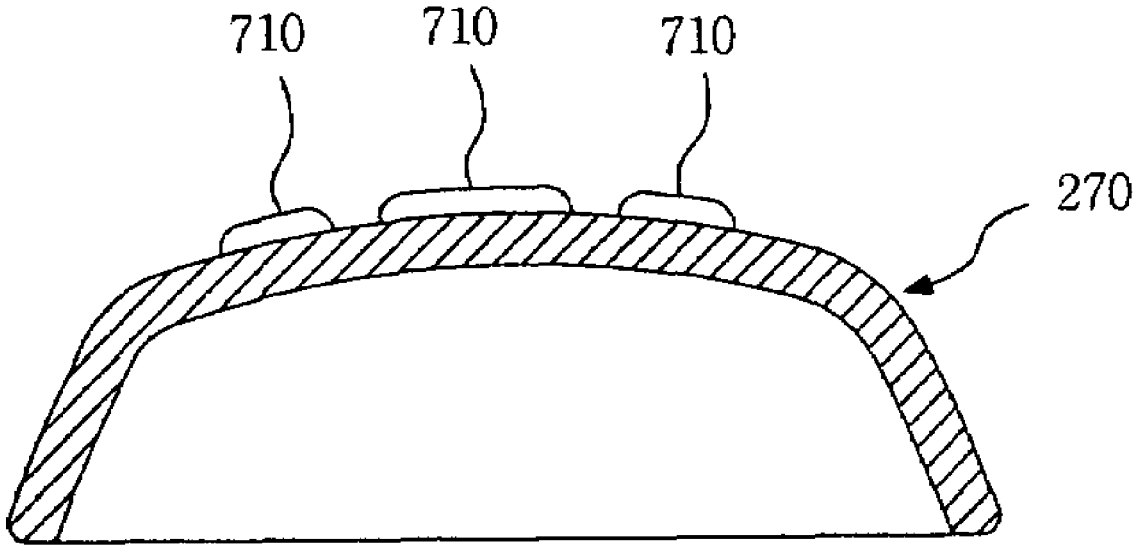
FIG. 3 is a section taken on line III-III in FIG. 1.

In one embodiment, in order to reduce the weight and the material cost, each lower surface of the first and second connection portions 130 and 150 may, as shown in FIG. 2, be opened to have "∩" shape. In addition, in order to reduce the weight and the material cost, a lower surface of the first foot supporting portion 170 may, as shown in FIG. 3, be also opened to have "∩" shape.

As shown in FIG. 1, the second foot supporting body (or second foot rest) 200 on which the feet of the user is placed is rotatably disposed on the first foot supporting body 100 such that the second foot supporting body 200 is wrapped around the seat supporter with the first foot supporting body at need. In one embodiment, the second foot supporting body 200 has a sector shape, and may include a second round portion 210, a third connection portion 230, a fourth connection portion 250, and a second foot supporting portion 270 that are disposed along an exterior circumference of the sector shape. In one embodiment, in order to reduce the weight and the material cost, the second foot supporting body 200 may have an open type that a center portion thereof is opened.

In one embodiment, the second round portion 210 at which two radiuses (R3: first line segment A2-O2, R4: second line segment B2-O2) of the sector shape are met with each other may be concavely rounded toward a segment A2-B2 of the sector shape such that the seat supporter 10 is contacted thereon. The third connection portion 230 is extended from one end of the second round portion 210 to one end of the segment A2-B2. The fourth connection portion 250 is extended from other end of the second round portion 210 to other end of the segment A2-B2. The second foot supporting portion 270 is formed along the segment A2-B2, and one end thereof is supported to the third connection portion 230 and other end thereof is supported to the fourth connection portion 250.

The second foot supporting portion 270 may have a structure that is supported to the second round portion 210 by the third and fourth connection portions 230 and 250. In one embodiment, in order to simplify the manufacture processes, the second round portion 210, the third connection portion 230, the fourth connection portion 250, and the second foot supporting portion 270 may be formed as a single body.

In one embodiment, in order to reduce the weight and the material cost, each lower surface of the third and fourth connection portions 230 and 250 may, as shown in FIG. 2, be opened to have "∩" shape. In addition, in order to reduce the weight and the material cost, a lower surface of the second foot supporting portion 270 may, as shown in FIG. 3, be also opened to have "∩" shape.

Referring to FIG. 1, the coupling part 300 is for removably fixing the first and second foot supporting bodies 100 and 200 to the seat supporter 10. That is, the coupling part 300 couples the second foot supporting body 200 to the first foot supporting body 100 such that the first and second foot supporting bodies 100 and 200 are fixed to the seat supporter 10, or the coupling part 300 uncouples the second foot supporting body 200 from the first foot supporting body 100 such that the first and second foot supporting bodies 100 and 200 are separated from the seat supporter 10. In more detail, the coupling part 300 may include a first coupling hole 310 that is formed at the first connection portion 130, a second coupling hole 320 that is formed at the third connection portion 230, and a bolt 340 that is coupled to a nut 330 after being sequentially inserted into the first and second coupling holes 310 and 320.

An assembly method that the first and second foot supporting bodies 100 and 200 are fixed to the seat supporter 10 may be as follows. First, the user contacts the first round portion 110 of the first foot supporting body 100 on a desired height (the desired height may be determined such that the feet of the user can be fully put on the first foot supporting body 100) of the seat supporter 10. Second, the user rotates the second foot supporting body 200 such that the second round portion 210 of the second foot supporting body 200 is contacted on the seat supporter 10, and thereafter, tightens the bolt 340. Accordingly, the first and second foot supporting bodies 100 and 200 are tightly fixed to the seat supporter 10 by the assembly method.

In addition, the above-mentioned second foot supporting body 200 may be rotatably disposed on the first foot supporting body 100 by a rotation unit 400.

With reference to FIG. 1, the rotation unit 400 may include a first extension portion 410 that is extended from the one end of the first round portion 110 along a concentric circle of the first round portion 110, a second extension portion 420 that is extended from the one end of the second round portion 210 along a concentric circle of the second round portion 210, a first mounting portion 430 that is formed at an end of the first extension portion 410, a second mounting portion 440 that is formed at an end of the second extension portion 420, and a pivot 450 that is vertically penetrated through the first and second mounting portions 430 and 440.

Accordingly, the second foot supporting body 200 can be rotated on the first foot supporting body 100 with respect to the pivot 450

In one embodiment, use of the first and second extension portions 410 and 420 provide the following advantage. Since the first and second foot supporting bodies 100 and 200 have the sector shape that has a central angle less than about 180°, the first and second round portions 110 and 210 may be difficult to be coupled to each other. Accordingly, if the first and second extensions 410 and 420 are further formed such that each of the first and second round portions 110 and 210 is a substantially perfect half circle, it may be easy that the first and second round portions 110 and 210 are coupled to each other. Furthermore, if the first and second extensions 410 and 420 are further formed, the first round portion 110, first extension portion 410, the second round portion 210 and the second extension portion 420 are substantially perfectly wrapped around the seat supporter 10, and accordingly, the first and second foot supporting bodies 100 and 200 can be prevented from being separated from the seat supporter 10 by external force (e.g., including force generated from the feet of the user).

In one embodiment, the foot supporting apparatus may further include an overlapping unit 500 such that the second foot supporting body 200 is overlapped with the first foot supporting body 100 when the second foot supporting body 200 is contacted on the first foot supporting body 100 after the second foot supporting body 200 is rotated with respect to the rotation unit 400.

Figure 7:
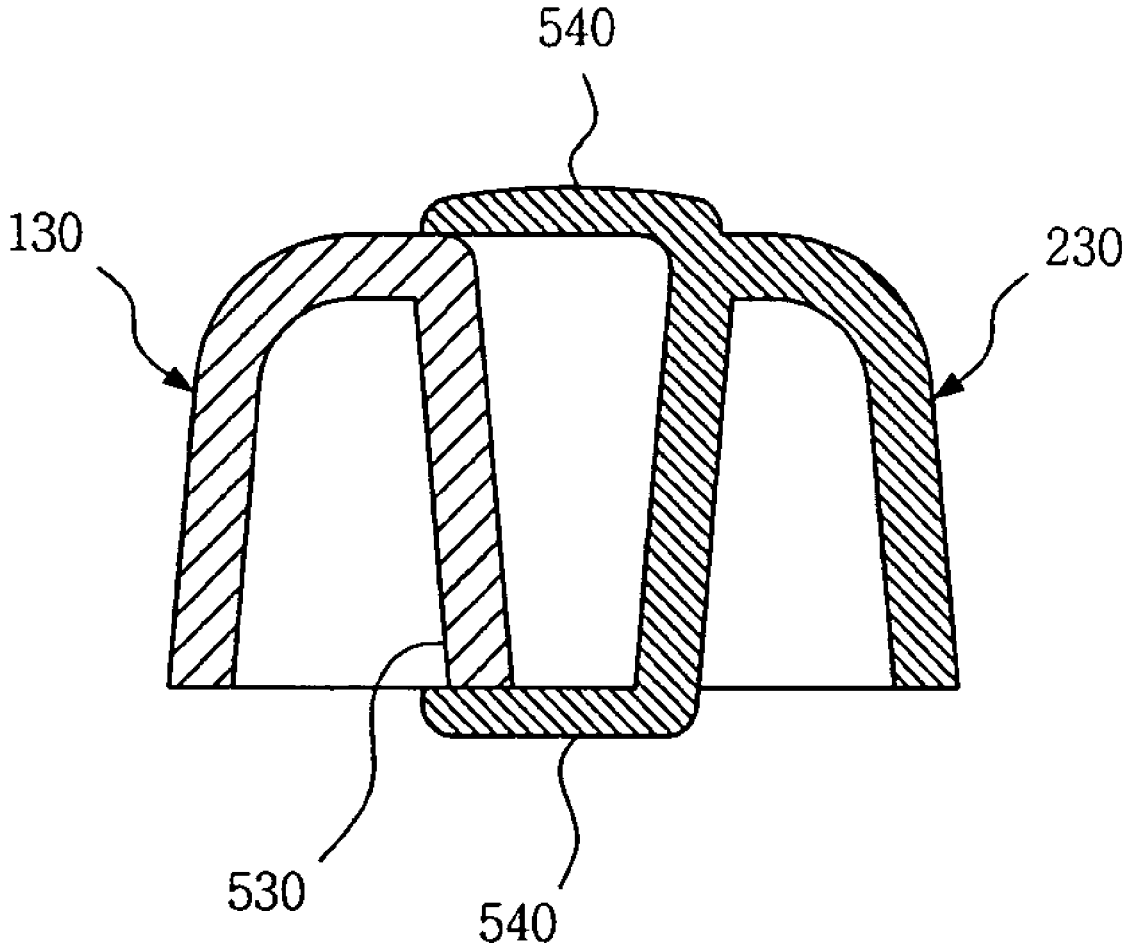
FIG. 7 is a section taken on line VII-VII in FIG. 5.

With reference to FIGS. 1 and 7, the overlapping unit 500 may include a first projection portion 510 that is formed on one end of the first foot supporting portion 170, and a first insertion portion 520 that is formed on the second foot supporting portion 270 such that the first projection portion 510 is inserted thereinto. In addition, the overlapping unit 500 may, as shown in FIG. 7, further include a second projection portion 530 that is formed on one side surface of the first connection portion 130, and a second insertion portion 540 that is formed on one side surface of the second connection portion 230 such that the second projection portion 530 is inserted thereinto. Furthermore, the overlapping unit 500 may further include a third projection portion 550 that is formed on other end of the first round portion 110, and a third insertion portion 560 that is formed on other end of the second round portion 210 such that the third projection portion 550 is inserted thereinto.

In one embodiment, since the foot supporting apparatus has a structure that the first foot supporting body 100 and the second foot supporting body 200 are overlapped with each other, the force generated from the feet can be transmitted to each of the first and second foot supporting bodies 100 and 200 at the same time. As a result, since the force of the feet is distributed to each of the first and second feet supporting bodies 100 and 200, the force of the feet can fully be supported thereby The foot supporting apparatus may further include a supplementary coupling unit 600 that is positioned between the first or second foot supporting body 100 or 200 and the seat supporter 10 such that the first and second foot supporting bodies 100 and 200 are prevented from moving on the seat supporter 10.

Figure 4:
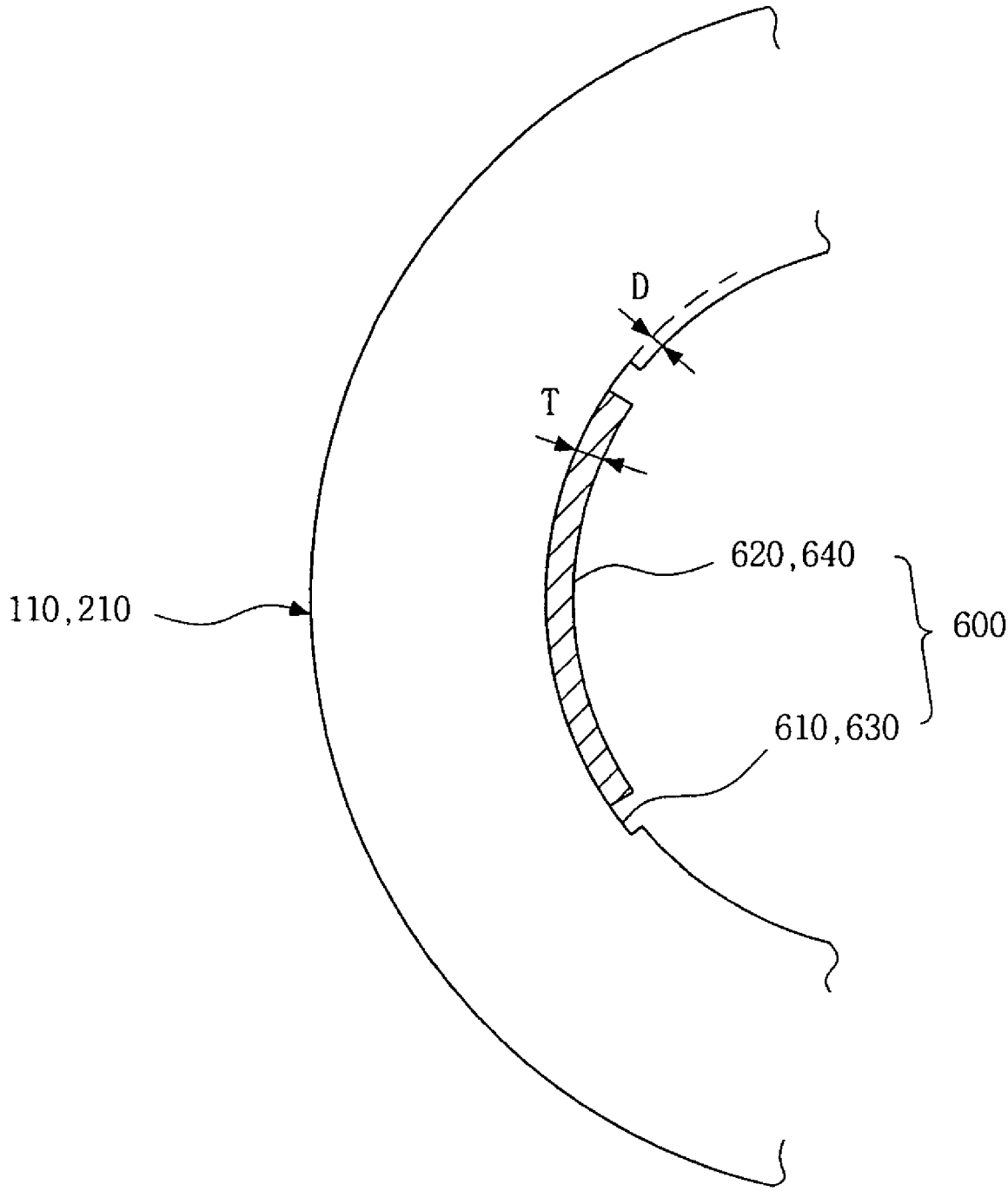
FIG. 4 is a partial cross-sectional view showing a supplementary coupling unit in the foot supporting apparatus of a chair according to one exemplary embodiment of the present invention.

With reference to FIG. 4, the supplementary coupling unit 600 may include a first groove 610 that is formed to an interior circumference of the first round portion 110, a first friction pad 620 that is adhered on the first groove 610, a second groove 630 that is formed to an interior circumference of the second round portion 210, and a second friction pad 640 that is adhered on the second groove 630. Accordingly, the first and second foot supporting bodies 100 and 200 can be substantially constantly positioned to a desired position (in which the first and third connection portions 130 and 230 are positioned toward a frond direction of the chair) without moving in a clockwise direction, in a counterclockwise direction, in an upper direction or in a lower direction. That is, the first and second foot supporting bodies 100 and 200 can be prevented from being positioned to a rear direction of the chair, which is not contacted on the feet of the user. In addition, as mentioned below, the coupling part 300 can be constantly positioned to the front direction of the chair, and the rotation unit 400 can be constantly positioned to the rear direction of the chair.

In addition, the first and second friction pads 620 and 640 may be formed of a resilience material such that external impact is absorbed. Such a resilience material may be, for example, sponge or rubber, etc. In one embodiment, in order to fully contact each interior circumference of the first and second friction pads on the exterior circumference of the seat supporter 10, each thickness of the first and second friction pads 620 and 640 may be bigger than each depth of the first and second grooves 610 and 630.

In one embodiment, the foot supporting apparatus may further include a slip avoidance part 700 that is disposed on each upper surface of the first and second foot supporting portions 170 and 270 such that the feet of the user is prevented from slipping thereoff. In one embodiment, the slip avoidance part 700 may, as shown in FIGS. 1 and 3, include a plurality of protrusions 710 that are formed on the each upper surface of the first and second foot supporting portions 170 and 270.

In one embodiment, the radius and the central angle of the first foot supporting body 100 with the sector shape may be equal to or substantially similar to those of the second foot supporting body 200 with the sector shape, for example, R1=R3 and $\alpha$1=$\alpha$2.

If the central angle $\alpha$1 of the first foot supporting body 100 becomes less than the central angle $\alpha$2 of the second foot supporting body 200, under the same radiuses (R1=R3), length of the segment A1-B1 and length of the first round portion 110 in the first foot supporting body 100 respectively become less than length of the segment A2-B2 and length of the second round portion 210 in the second foot supporting body 200, and accordingly, the first foot supporting body 100 may be relatively weak to the force or the weigh of the feet. However, as mentioned above, if the radius and the central angle of the first foot supporting body 100 may be equal or substantially similar to those of the second foot supporting body 200, since the first and second foot supporting bodies 100 and 200 have a substantially symmetric shape to each other, the force or the load of the feet can be evenly distributed to the each of the first and second foot supporting bodies 100 and 200. As a result, a weak portion may not be generated therefrom.

In one embodiment, in order to also distribute the force or the load of the feet, the coupling part 300 and the rotation unit 400 may be substantially symmetrically positioned with respect to the seat supporter. If both of the coupling part 300 and the rotation unit 400 are mounted to any one side, the one side may be relatively weak.

In addition, the coupling part 300 may be positioned to the front direction of the chair with respect to the seat supporter 10, and the rotation unit 400 may be positioned to the rear direction of the chair with respect to the seat supporter 10. In one embodiment, to position the coupling part 300 to the front direction of the chair means to position the firs and second foot supporting bodies 100 and 200 to the front direction of the chair. Accordingly, the feet of the user, which is put on the front direction of the chair, can be substantially perfectly supported by the first and second foot supporting bodies 100 and 200.

Furthermore, as mentioned above, if the coupling part 300 and the rotation unit 400 are respectively positioned to the front direction and the rear direction of the chair with respect to the seat supporter 10, force that is transmitted to the coupling part 300 and the rotation unit 400 can be distributed into lower direction force that is transmitted to the coupling part 300 and upper direction force that is transmitted to the rotation unit 400. That is, the lower direction force of the force may be supported by the coupling part 300, and the upper direction force of the force may be supported by the rotation unit 400. However, if the coupling part 300 and the rotation unit 400 are respectively positioned to a left direction and a right direction of the chair with respect to the seat supporter 10, the force may be not distributed into the lower direction force and the upper direction force, but may be concentrated into the lower direction force, and accordingly, the coupling part 300 and the rotation unit 400 are intensively pressed by the concentrated lower direction force, that is, the coupling part 300 and the rotation unit 400 may be weakened by the concentrated lower direction force.

Figure 5:
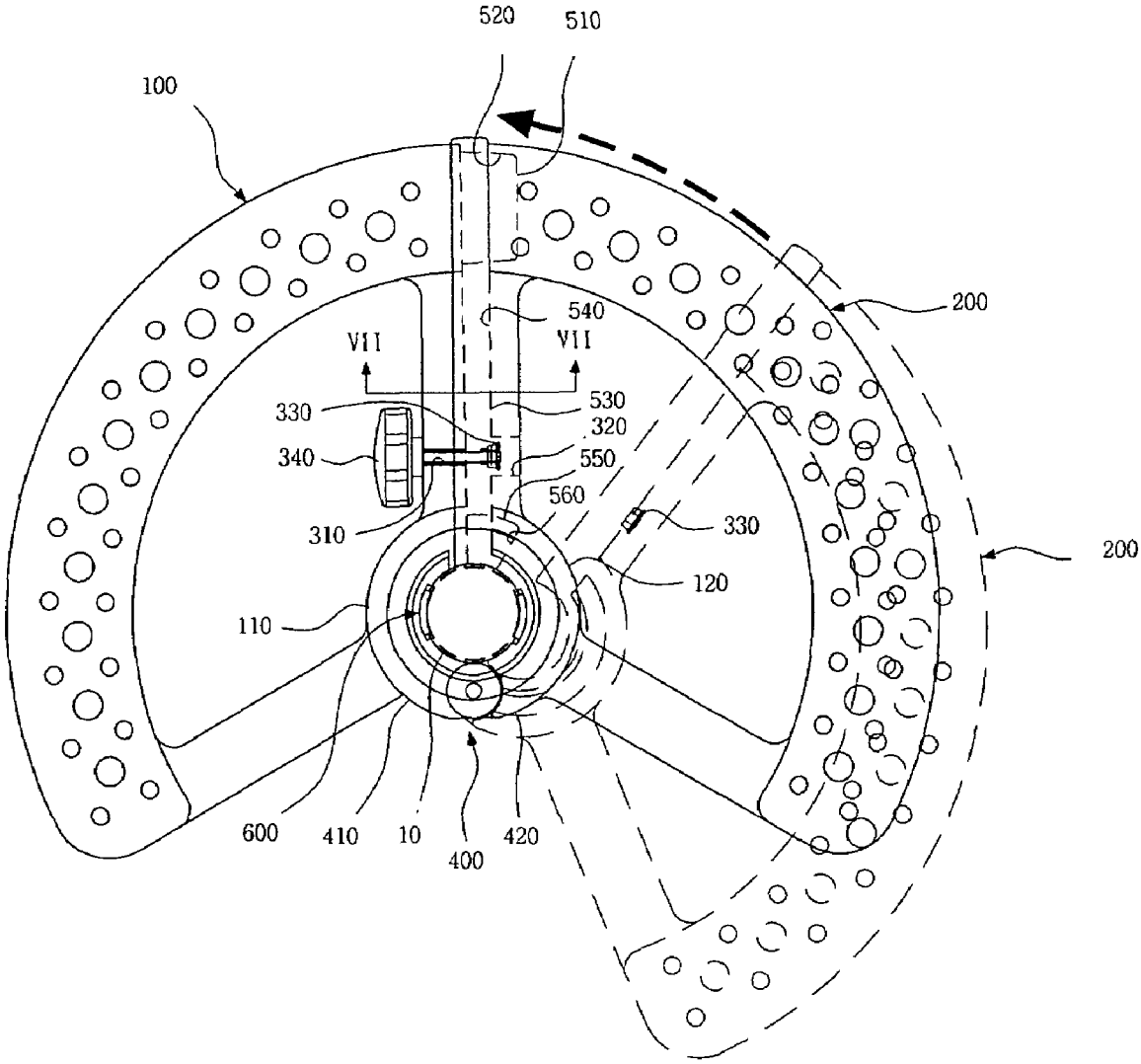
FIGS. 5 and 6 are top plane views showing motions of the foot supporting apparatus of a chair according to one exemplary embodiment of the present invention.
Figure 6:
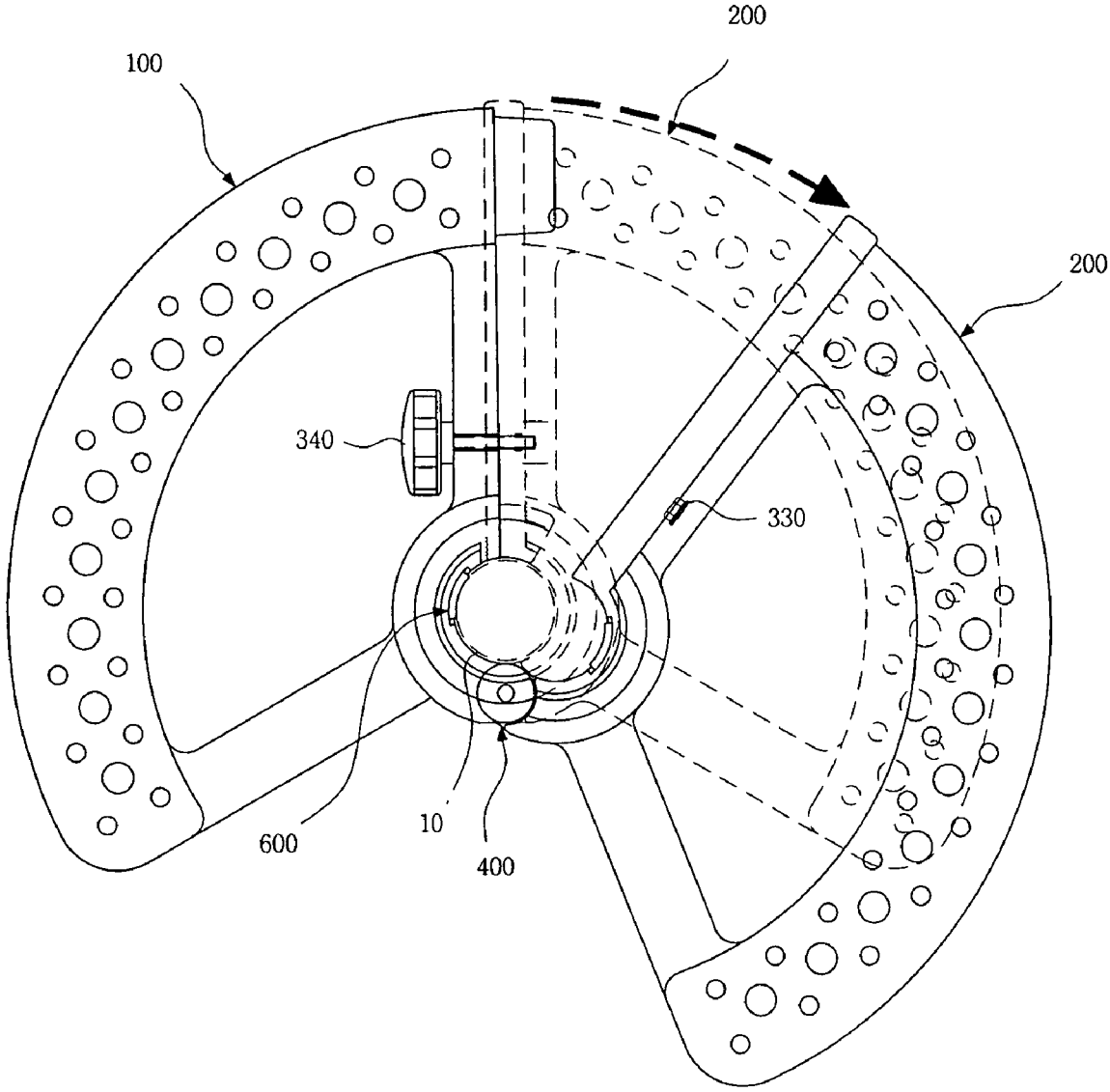

With reference to FIGS. 5 and 6, operations of the foot supporting apparatus of a chair according to one exemplary embodiment of the present invention will hereinafter be described in detail.

First, in order to couple the foot supporting apparatus to the seat supporter 10, as shown in FIG. 5, the user positions the first and second foot supporting bodies 100 and 200 to the desired height of the seat supporter 10, and rotate the second foot supporting body 200 with respect to the rotation unit 400 such that the second foot supporting body 200 is rotated toward the first foot supporting body 100. And then, the first, second and third projections 510, 530 and 550 are respectively inserted into the first, second and third insertion portions 520, 540 and 560. Thereafter, if the user tights the bolt 340 after inserting the bolt 340 into the first and second coupling holes 310 and 320, the second foot supporting body 200 is substantially perfectly fixed to the first foot supporting body 100. Such a coupling force tights the first and second round portions 110 and 210, and the first and second extensions 410 and 420, by which the seat supporter 10 is tightly grasped.

Second, in order to uncouple the foot supporting apparatus to the seat supporter 10, as shown in FIG. 6, the user uncouples the bolt 340, and rotates the second foot supporting body 200 in the clockwise direction. Thereafter, the user separates the foot supporting apparatus from the seat supporter 10.

Figure 8:
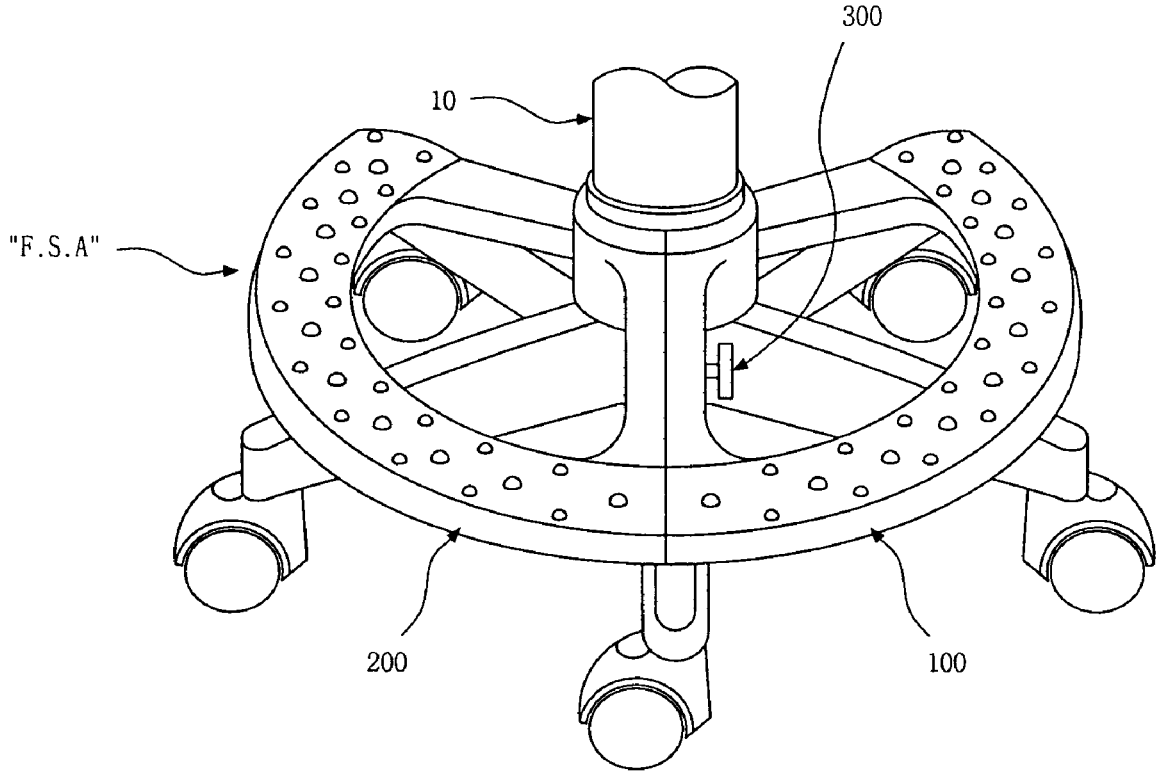
FIG. 8 is a perspective view showing a state in which the foot supporting apparatus of a chair according to one exemplary embodiment of the present invention is coupled to a seat supporter.

In addition, FIG. 8 is a perspective view showing a state in which the foot supporting apparatus of a chair (F.S.A) according to an exemplary embodiment of the present invention is coupled to the seat supporter 10.

According to at least one embodiment of the present invention, the height of the foot supporting apparatus can be adjusted according to the length of the legs of the user. In addition, the force of the feet of the user can be fully supported.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are embraced within their scope.

What is claimed is:

1. A foot supporting apparatus for use with a chair, the apparatus comprising:

a first foot supporting body comprising a first foot supporting surface configured to support at least one of the feet of a user;

a second foot supporting body comprising a second foot supporting surface configured to support at least one of the feet of the user; and a coupler configured to couple the first and second foot supporting bodies such that at least part of the first foot supporting surface and at least part of the second foot supporting surface extend generally on a single imaginary plane, wherein the coupler is further configured to uncouple the second foot supporting body from the first foot supporting body, wherein the first foot supporting body comprises:

a first round portion configured to contact a seat supporter of a chair;

a first foot supporting portion comprising the first foot supporting surface; and at least one first connection portion interconnecting the first round portion and the first foot supporting portion, wherein the second foot supporting body comprises:

a second round portion configured to contact the seat supporter, wherein the first and second round portions are together configured to surround the seat supporter when the first and second foot supporting bodies are coupled together;

a second foot supporting portion comprising the second foot supporting surface; and at least one second connection portion interconnecting the second round portion and the second foot supporting portion, wherein each of the first and second round portions comprises two ends, and wherein one end of the first round portion is hingedly connected to one end of the second round portion via a pivot, and wherein the second foot supporting body is configured to overlap with the first foot supporting body by an overlapping unit.

2. The foot supporting apparatus of claim 1, wherein the overlapping unit comprises:

a first projection portion formed on the first foot supporting portion; and a first insertion portion formed on the second foot supporting portion and configured to receive the first projection portion.

3. The foot supporting apparatus of claim 2, wherein the overlapping unit further comprises:

a second projection portion formed on a side surface of the at least one first connection portion; and a second insertion, portion formed on a side surface of the at least one second connection portion and configured to receive the second projection portion.

4. The foot supporting apparatus of claim 3, wherein the overlapping unit further comprises:

a third projection portion formed on the other end of the first round portion; and a third insertion portion formed on the other end of the second round portion and configured to receive the third projection portion.

5. A foot supporting apparatus for use with a chair, the apparatus comprising:

a first foot supporting body comprising a first foot supporting surface configured to support at least one of the feet of a user;

a second foot supporting body comprising a second foot supporting surface configured to support at least one of the feet of the user; and a coupler configured to couple the first and second foot supporting bodies such that at least part of the first foot supporting surface and at least part of the second foot supporting surface extend generally on a single imaginary plane, wherein the coupler is further configured to uncouple the second foot supporting body from the first foot supporting body, wherein the first foot supporting body comprises:

a first round portion configured to contact a seat supporter of a chair;

a first foot supporting portion comprising the first foot supporting surface; and at least one first connection portion interconnecting the first round portion and the first foot supporting portion, wherein the second foot supporting body comprises:

a second round portion configured to contact the seat supporter, wherein the first and second round portions are together configured to surround the seat supporter when the first and second foot supporting bodies are coupled together;

a second foot supporting portion comprising the second foot supporting surface; and at least one second connection portion interconnecting the second round portion and the second foot supporting portion, and wherein the foot supporting apparatus further comprises a supplementary coupling unit configured to be positioned between the first or second foot supporting body and the seat supporter so as to prevent the first and second foot supporting bodies from moving on the seat supporter.

6. The foot supporting apparatus of claim 5, wherein the supplementary coupling unit comprises:

a first groove formed on an interior circumference of the first round portion;

a first friction pad formed on the first groove;

a second groove formed on an interior circumference of the second round portion; and a second friction pad formed on the second groove.

7. The foot supporting apparatus of claim 6, wherein the first and second friction pads are formed of a resilient material.

* * * * *